United States Patent [19]

Lakomsky et al.

[11] 4,112,246

[45] Sep. 5, 1978

[54] PLASMARC FURNACE FOR REMELTING METALS AND ALLOYS

[76] Inventors: Viktor Iosifovich Lakomsky, ulitsa Anri Barbjusa, 22-26, kv. 119; Ivan Vasilievich Sheiko, ulitsa Schuseva, 36, kv. 32; Georgy Mikhailovich Grigorenko, ulitsa Frolovskaya, 1, kv. 5; Gennady Fedorovich Torkhov, ulitsa Prazhskaya, 3, kv. 456; Vladimir Kirillovich Trigub, ulitsa Vernadskogo, 63, kv. 61, all of Kiev; Albert Nikitovich Korotkov, prospekt Lenina, 228, kv. 2, Zaporozhie; Viktor Mikhailovich Kurganov, prospekt Lenina, 120, kv. 8, Zaporozhie; Evgeny Isaevich Moshkevich, ulitsa Stalevarov, 30, kv. 47, Zaporozhie; Alexei Ivanovich Pakhomov, ulitsa Pravdy, 25, kv. 9, Zaporozhie; Emil Vasilievich Verkhovtsev, ulitsa Ordzhonikidze, 28, kv. 9, Izhevsk, all of U.S.S.R.

[21] Appl. No.: 734,032

[22] Filed: Oct. 20, 1976

[51] Int. Cl.[2] ..... H05H 1/26

[52] U.S. Cl. ..... 13/2 P

[58] Field of Search ..... 13/2 P, 9, 34; 219/121 P

[56] References Cited

U.S. PATENT DOCUMENTS

| | | | |
|---|---|---|---|
| 3,524,006 | 8/1970 | Ebeling et al. | 13/34 |
| 3,723,630 | 3/1973 | Paton et al. | 13/9 |

*Primary Examiner*—R. N. Envall, Jr.

*Attorney, Agent, or Firm*—Holman & Stern

[57] ABSTRACT

A plasmarc furnace for remelting metals and alloys in a controlled atmosphere, which comprises a hollow consumable electrode disposed in a crystallizer and an arc plasmatron with a nonconsumable electrode disposed above the hollow consumable electrode coaxially therewith. A hollow rod is provided above and coaxial with the arc plasmation driven by a vertical travel mechanism and insulated from the arc plasmatron leads. The plasma-forming gas is delivered to the plasma discharge zone by a plasma-forming gas supply and flow rate control system via a gas conduit defined by the cavities of the hollow rod, the arc plasmatron and the hollow consumable electrode. The crystallizer and hollow rod are coupled to the opposite poles of the power source.

2 Claims, 2 Drawing Figures

PLASMARC FURNACE FOR REMELTING METALS AND ALLOYS

BACKGROUND OF THE INVENTION

The present invention relates to electrometallurgy, and, more particularly, to plasma-arc-furnaces for remelting metals and alloys; it may be advantageously employed for manufacturing ingots of pure metals, steels and alloys.

The rapidly advancing modern industries, such as aerospace engineering, atomic power engineering, chemistry, electronics and cryogenics, impose ever more stringent requirements on the purity of metals and alloys. At present, metals and alloys are customarily remelted in electroslag, vacuum-arc, electron-beam and plasma-arc furnaces with a view to improving their purity and processing behaviour.

These methods are all characterized by that the operations of melting, teeming and crystallization are synchronized, and the ingot is formed in a water-cooled copper crystallizer, with the molten metal and heat being continuously supplied through the open surface of the molten pool. The molten metal is transferred from the end face of the billet being remelted or the electrode to the crystallizer in small portions (drops) uniformly distributed in time, thereby providing for an extremely extended reactive surface area.

The plasma-arc technique of remelting offers the largest scope of means of affecting molten metal, such as gas, slag, vacuum and directed crystallization, for producing homogeneous ingots with a high surface quality negligibly low levels of nonmetallic inclusions and gases.

As far as the manufacture of large ingots is concerned, one of the most promising techniques of plasma-arc remelting is one wherein the plasma generator is formed is a hollow consumable electrode wherein the cavity defines a channel for the passage of plasma-forming gas to the plasma-burning zone. This technique of plasma-arc remelting features low rates of power and plasma-forming gas consumption, as well as high productivity and excellent quality of the product metal.

The plasma-arc furnace for remelting metals and alloys operating on the foregoing principle comprises a crystallizer and a melting chamber which are put together, defining a closed air-tight space. The hollow consumable electrode is attached to a hollow rod entering the chamber in such a manner that its axis coincides with the axis of the crystallizer. The furnace is provided with a plasma-forming gas supply and flow rate control system, and the hollow rod and the crystallizer are coupled to the opposite poles of the power source.

The above-described furnace, however, features an important disadvantage detracting from the efficiency of the process and adversely affecting its economics: its design makes it difficult to eliminate the shrinkage cavities in the ingot at the end of the melting process.

The available methods for eliminating shrinkage cavities, which are employed in the electroslag, vacuum-arc, electron-beam and ordinary plasma-arc remelting processes whereby the electric power is gradually decreased at the end of remelting, proved of little use. The reason for this should be sought in the fact that, as the power supplied to the plasma discharge generated by the hollow consumable electrode is reduced, the burning stability deteriorates sharply so that the arc is destabilized. As a result of substantial fluctuations of current intensity and voltage across the arc, the process of uniform crystallization of the ingot head is disrupted, giving rise to shrinkage cavities at a depth equal to 0.3 to 0.5 of the ingot diameter. Thus, this portion of the ingot has to be cut off, as a rule, reducing the yield of metal and detracting from the economic and technical efficiency of the process.

SUMMARY OF THE INVENTION

It is an object of the present invention to obviate the foregoing disadvantages of the above-described furnace.

The invention provides a plasma-arc furnace for remelting metals and alloys in a controlled atmosphere, which would enable the shrinkage cavities in the ingot to be effectively eliminated and improve the efficiency and economics of the remelting process.

It is an object of the present invention to obviate the mentioned disadvantages of the foregoing furnace.

It is another object of the present invention to provide a plasma-arc furnace for remelting metals and alloys in a controlled atmosphere, which would enable the ingot shrinkage cavities to be effectively eliminated and improve the technical and economic efficiency of the process.

Accordingly, there is provided a plasma-arc furnace for remelting metals and alloys in a controlled atmosphere comprising a hollow consumable electrode disposed in a crystallizer and a hollow rod disposed above said hollow consumable electrode in coaxial relationship therewith, said hollow rod being driven by a vertical-travel mechanism, and the cavity of the consumable electrode is connected with a plasma-forming gas supply and flow rate control system, the crystallizer and the hollow rod being coupled to the opposite poles of the power supply source, wherein, in accordance with the invention, between the hollow consumable electrode and the hollow rod and in coaxial relationship therewith is an arc plasmatron with a nonconsumable electrode. The leads thereof are insulated from the hollow rod. The plasma-forming gas supply and flow rate control system together with the cavities of the rod, the arc plasmatron and the consumable electrode defining a gas conduit affording means of passage for the plasma-forming gas to the plasma-discharge zone.

The arc plasmatron with a nonconsumable electrode may be supplied from an independent power source.

The arc plasmatron with a nonconsumable electrode, incorporated into the plasma-arc furnace for remelting metals and alloys as a novel feature of this invention, is an effective means of totally eliminating shrinkage cavities in the ingot head, improving its density and raising the output of quality metal.

While the shrinkage cavities are being eliminated, the process proceeds in a stable manner, and there are no current intensity fluctuations in the plasma discharge generated by the arc plasmatron with a nonconsumable electrode.

Furthermore, the foregoing design feature rules out any possibility of the plasma discharge attacking the crystallizer wall.

BRIEF DESCRIPTION OF THE DRAWINGS

The invention will be further understood from the following description of a preferred embodiment thereof taken in conjunction with the accompanying drawings, wherein.

DETAILED DESCRIPTION OF PREFERRED EMBODIMENT

Figure 1:
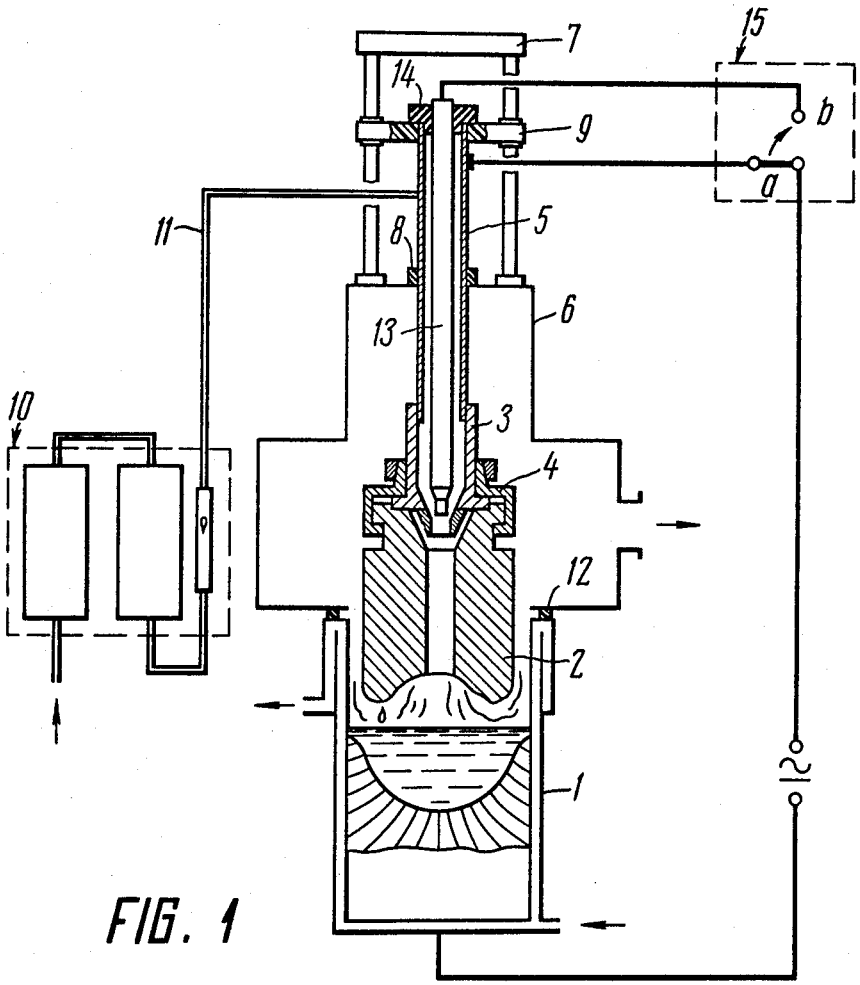
FIG. 1 is a diagram of a plasma-arc furnace for remelting metals and alloys in a controlled atmosphere with a common power source supplying the hollow consumable plasmatron and the arc plasmatron with a nonconsumable electrode.

Referring now to the drawings, the plasma-arc furnace for remelting metals and alloys in a controlled atmosphere, in accordance with the invention, comprises a crystallizer 1 which accommodates, in coaxial relationship therewith, a hollow consumable electrode 2 attached to the lower end of an arc plasmatron 3 with a nonconsumable electrode 13. The hollow consumable electrode 2 is attached to the arc plasmatron 3 with the aid of half-sleeves 4 constructed from an electrically conductive material. The arc plasmatron 3 is rigidly fastened to the lower end of a hollow rod 5 in coaxial relationship therewith. The hollow consumable electrode 2 and the arc plasmatron 3 are accommodated in a chamber 6 which joins the crystallizer 1 to define a working chamber with a controlled atmosphere. The upper end of the rod 5 is connected to a vertical-travel mechanism 7 driving the hollow consumable electrode 2.

The hollow rod 5 is electrically insulated from the chamber 6 and the vertical-travel mechanism 7 with insulators 8 and 9. To provide the furnace with plasma-forming gas, the former is equipped with a system 10 for supplying and controlling the flow rate of plasma-forming gas, the system 10 being connected with the rod 5 by means of a flexible hose 11, bypassing the chamber 6.

When assembled together, the flexible hose 11 and the cavities of the hollow rod 5, the arc plasmatron 3 and the hollow consumable electrode 2 define a gas conduit affording means of passage for the plasma-forming gas from the system 10 to the plasma-discharge zone.

The joint between the chamber 6 and the crystallizer 1 is sealed with the aid of an annular rubber sealing 12.

The hollow rod 5 and the crystallizer 1 are coupled to the opposite poles of an a.c. or d.c. power source and constitute current-carrying elements in the power circuit while the furnace is in operation.

Nonconsumable electrode 13 of the arc plasmatron 3 is electrically insulated from the hollow rod 5 with the aid of an insulator 14.

In order that the arc plasmatron 3 may operate in a shrinkage cavity elimination mode, the power circuit incorporates a two-way switch 15, which by the common power source alternately supplies the arc plasmatron 3 and the hollow consumable electrode 2.

Where the plasma-forming gas supplied into the plasma-discharge zone from the system 10 (FIG. 2) is to be preheated, the arc plasmatron 3 is supplied from an independent power source 16. Such an arrangement provides for a combined mode under which the arc plasmatron 3 operates while the hollow consumable electrode 2 may simultaneously generate a plasma discharge.

The plasma-arc of this invention is equipped with a vacuum pump (not shown) to evacuate the working chamber of the furnace.

The inventive idea will become more apparent from the following example illustrating the operation of the inventive plasma-arc furnace for remelting metals and alloys in a controlled atmosphere (FIG. 1).

EXAMPLE 1

The hollow consumable electrode 2 is placed in the crystallizer 1 coaxially therewith. A bed of seed of material idential to the material to be remelted is placed on the bottom of the crystallizer 1.

The seed bed protects the bottom of the crystallizer 1 against the direct effect of the plasma flame at the early stage of melting when the crystallizer contains no molten pool as yet.

Then the working chamber of the furnace is hermetically sealed by joining the crystallizer 1 with the sealing 12 to the chamber 6, evacuating the working chamber thus formed and filling it with plasma-forming gas from the plasma-forming gas supply and flow rate control system 10 to a desired pressure.

Following this, a specified flow rate of the plasma-forming gas is set by means of the plasma-forming gas supply and flow rate control system 10, the plasma-forming gas being delivered from the system 10 via the flexible hose 11 and the cavities of the hollow rod 5, the arc plasmatron 3 and the hollow consumable electrode 2 into the plasma-discharge zone. By connecting the power source, an electric arc discharge is induced between the end face of the hollow consumable electrode 2 and the seed bed on the bottom of the crystallizer 1. The plasma-forming gas is ionized in the electric arc column, giving rise to a column of plasma in the space between the end face of the hollow consumable electrode 2 and the seed bed, the column issuing from the cavity of the consumable electrode 2 as a flame. The heat generated in the vicinity of the electrode and in the plasma column causes the lower end of the electrode to melt, flowing off the electrode 2 and into the crystallizer 1 to form a molten pool. As the crystallizer 2 is progressively filled, the pool level rises and the arc plasma zone moves upward. Since the space factor of the crystallizer 1 is less than unity, the consumable electrode 2 is driven vertically downward with the aid of the rod 5 and the vertical-travel mechanism 7, as the electrode 2 is progressively consumed.

While eliminating the shrinkage cavities in the ingot, the plasma discharge generated by the hollow consumable electrode 2 is turned off by deenergizing the consumable electrode 2 with the aid of the switch 15, simultaneously switching on the arc plasmatron 3 which operates throughout the entire period of shrinkage cavity elimination.

The need to cut off the hollow consumable electrode 2 for the period of shrinkage cavity elimination stems from the fact that the plasma discharge stability sharply deteriorates as the power supply is reduced, threatening to become an arc discharge which is accompanied by substantial current intensity and voltage fluctuations, disrupting the stability of crystallization of the ingot head. Moreover, the arc may surge as far as the wall of the crystallizer 1, putting it out of action.

While the molten pool is heated with the plasma generated by the arc plasmatron 3, the hollow consumable electrode 2 does not melt and no newly molten metal enters the crystallizer. so that the process of ingot head crystallization proceeds in a stable fashion.

At the end of the melting procedure, the arc plasmatron 3 is switched on, and the supply of plasma-forming gas is discontinued, after which the furnace is depressurized and the ingot is withdrawn from the crystallizer 1.

EXAMPLE 2

Figure 2:
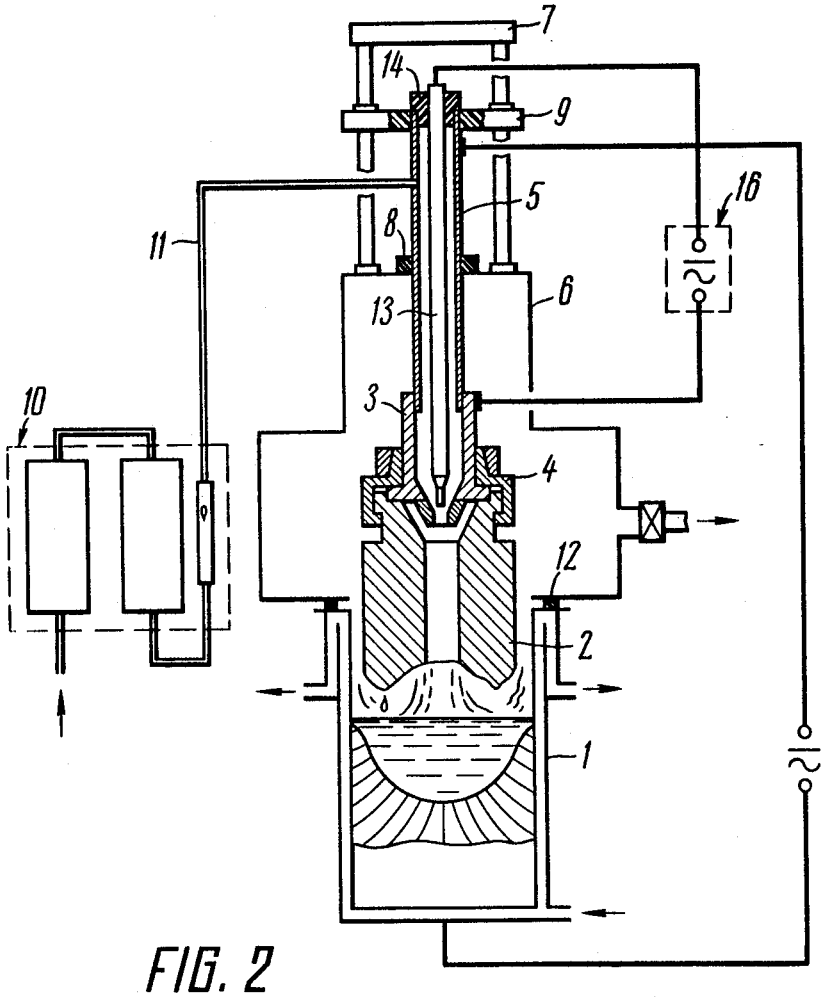
FIG. 2 is a diagram of the same furnace but with independent sources of supply provided for the hollow consumable electrode and the arc plasmatron with a nonconsumable electrode.

This example illustrates the operation of the plasma-arc furnace in case the plasma-forming gas is to be preheated (FIG. 2).

The hollow consumable electrode 2 is coaxially secured to the lower end of the arc plasmatron 3 with the aid of the half-sleeves 4 and placed in the crystallizer 1 in coaxial relationship therewith. A seed bed of a material identical with the material to be remelted is placed on the bottom of the crystallizer 1, whereupon the furnace is sealed, evacuated and filled with gas from the system 10 to a specified pressure, after which a specified flow rate of the plasma-forming gas is set.

In order to facilitate the ionization of the gas in the space below the end face of the hollow consumable electrode 2, thereby raising the stability of the plasma discharge generated by the hollow consumable electrode 2, the plasma-forming gas is preheated. To this end, the arc plasmatron 3 is switched on from the independent power source 16. Then a plasma discharge is induced between the end face of the hollow consumable electrode 2 and the seed bed on the bottom of the crystallizer 1.

The plasma-forming gas fed from the system 10 passes through the operating arc plasmatron 3, gets heated thereby and enters the cavity of the consumable electrode 2. In such a case, the arc plasmatron 3 and the hollow consumable electrode 2 are supplied from independent power sources.

While the shrinkage cavities in the ingot are being eliminated, the plasma discharge generated by the hollow consumable electrode 2 is discontinued by deenergizing the hollow consumable electrode 2, the arc plasmatron 3 operating through out the entire period of shrinkage cavity elimination.

When the melting procedure is over, the arc plasmatron 3 is switched off, the plasma-forming gas supply is discontinued, the furnace is depressurized, and the ingot is withdrawn from the crystallizer 1.

Tests of a pilot furnace of the above type indicated its high potential. The furnace provided for a high stability of operation at all stages of remelting.

The ingots produced showed smooth surfaces; no shrinkage cavities were detected.

What is claimed is:

1. A plasma-arc furnace for remelting metals and alloys in a controlled atmosphere, which comprises: a crystallizer; a hollow consumable electrode having an axial cavity accommodated in said crystallizer; an arc plasmatron having an axial cavity and leads with a nonconsumable electrode disposed above said hollow consumable electrode in coaxial relationship therewith; a hollow rod having an axial cavity disposed above said arc plasmatron with a nonconsumable electrode in coaxial relationship therewith; a vertical-travel mechanism connected to said hollow rod and driving same; a plasma-forming gas supply and flow rate control system connected with the plasma-discharge zone via a gas conduit defined by the cavities of the hollow rop, the arc plasmatron and the consumable electrode; and a source of electric power supply having opposite poles; said crystallizer and said hollow rod are coupled to the opposite poles of the source of electric power supply, and the leads of said arc plasmatron are insulated from the hollow rod.

2. The plasma-arc furnace as set forth in claim 1, wherein said arc plasmatron with a nonconsumable electrode is coupled to an independent source of electric power supply.

* * * * *